US007290470B1

(12) United States Patent
Peters

(10) Patent No.: US 7,290,470 B1
(45) Date of Patent: Nov. 6, 2007

(54) MULTI-BIT DRIVER WITH ROTATABLE SLEEVE

(75) Inventor: Michael P. Peters, Lutherville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/489,215

(22) Filed: Jul. 19, 2006

(51) Int. Cl.
*B25B 23/12* (2006.01)
*B25B 15/00* (2006.01)
*B25B 23/16* (2006.01)

(52) U.S. Cl. ..... 81/439; 81/451

(58) Field of Classification Search ..... 81/439, 81/451
See application file for complete search history.

(56) References Cited

U.S. PATENT DOCUMENTS 5,806,381 A * 9/1998 Lin ..... 81/58.4
5,954,463 A * 9/1999 Jore ..... 408/239 R
6,354,177 B2 * 3/2002 Peters ..... 81/439
6,488,452 B1 * 12/2002 Hoskins et al. ..... 408/239 R
6,511,268 B1 * 1/2003 Vasudeva et al. ..... 408/239 R

* cited by examiner

*Primary Examiner*—David B Thomas
(74) *Attorney, Agent, or Firm*—Harness, Dickey & Pierce, P.L.C.

(57) ABSTRACT

A rotary tool includes a tool holder, a reversible bit, and an outer rotatable sleeve. The tool holder includes a socket and a shank. The socket includes an opening extending rearwardly from an end thereof. The shank is integral with and extends rearwardly from the socket and includes a non-circular cross-section. The reversible bit includes an inner sleeve, a first reversible bit driver, and a second reversible bit driver. The inner sleeve is disposed within the socket and rotates with the tool holder. One of the first and second bit drivers extends axially out of the socket opening. The outer rotatable sleeve is disposed over at least a portion of the socket and the bit driver extending axially out of the socket opening. The outer rotatable sleeve further includes a magnet in an end proximate the bit driver extending axially out of the socket opening.

17 Claims, 2 Drawing Sheets

MULTI-BIT DRIVER WITH ROTATABLE SLEEVE

FIELD

The present disclosure relates to a rotatable tool, and more specifically to a tool holder having a reversible bit assembly and a rotatable sleeve.

BACKGROUND

The statements in this section merely provide background information related to the present disclosure and may not constitute prior art.

When purchasing various rotary tools, professional tradesmen and do-it-yourselfers are frequently required to purchase several of a series of tool or driver configurations that have different types of driving ends, e.g. Philips®, Torx® and flat head, as well as various hexangle nut driver configurations in metric and English units. The combinations of different tools for a given task may require the use of various different driving ends. Thus, the cost associated with having a complete set of tools is increased since each tool is generally sold separately. Moreover, there is a significant drawback for a user of many different tools in that the user must carry with him or her a specific tool for each task to be accomplished. For example, a user may need to bring multiple screw drivers and nut drivers to accomplish a single task. As a consequence, the user's tool belt or tool box soon becomes cluttered with these various implements resulting in an increase in the weight of the tools the user must carry from one location to another. Likewise, boaters, motorists, bicyclists, and homeowners have a need for a single multipurpose rotary tool that can be stored conveniently and compactly for use in an emergency or otherwise.

Further, when using these rotary tools in a space proximate another wall or other object, the rotating shaft of the tool can be abrasive to the wall or object. Additionally, if a user attempts to guide the shaft with his hand, there is friction present between the hand and shaft, which may result in discomfort.

Further yet, a user is often required to hold a fastener with one hand against a bit of the tool, while operating the tool with his second hand. This can be troublesome, especially in tight spaces and may result in dropped and even lost fasteners.

All of these developments have created a need for a single rotary tool that has a variety of functions and serves as a multiple rotary tool, while eliminating the aforementioned inconveniences. However, this need has not been easily achieved. Hence, there exists a need for a single rotary tool and kit that functions as a multipurpose tool which can be stored and organized in a convenient manner and having the approximate size of a conventional single purpose rotary tool.

SUMMARY

According to the present disclosure, a rotary tool includes a tool holder, a reversible bit, and a rotatable sleeve. The tool holder includes a socket and a shank. The socket includes an opening extending rearwardly from an end thereof. The shank is integral with and extends rearwardly from the socket and includes a non-circular cross-section. The reversible bit includes an inner sleeve, a first reversible bit driver, and a second reversible bit driver. The inner sleeve is disposed within the socket and rotates with the tool holder.

One of the first and second bit drivers extends axially out of the socket opening. A rotatable outer sleeve is disposed over at least a portion of the socket and the bit driver extending axially out of the socket opening. The rotatable outer sleeve further includes a magnet in an end proximate the bit driver extending axially out of the socket opening.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
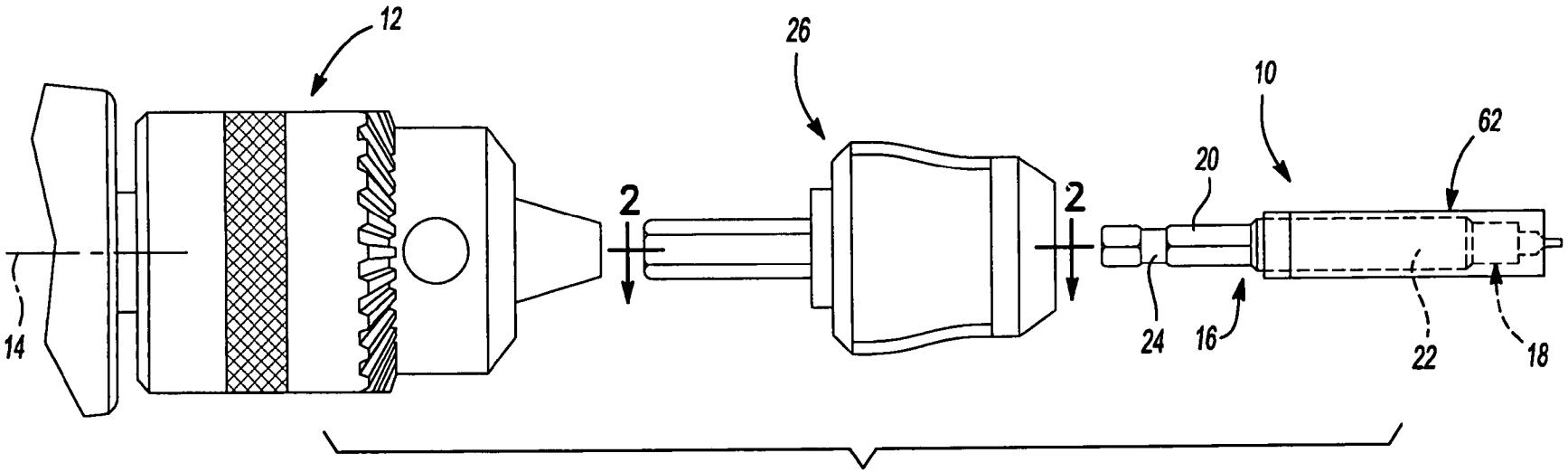
FIG. 1 is an exploded view of a rotary tool in association with a power tool having a keyless chuck or coupler interdisposed therebetween.
Figure 2:
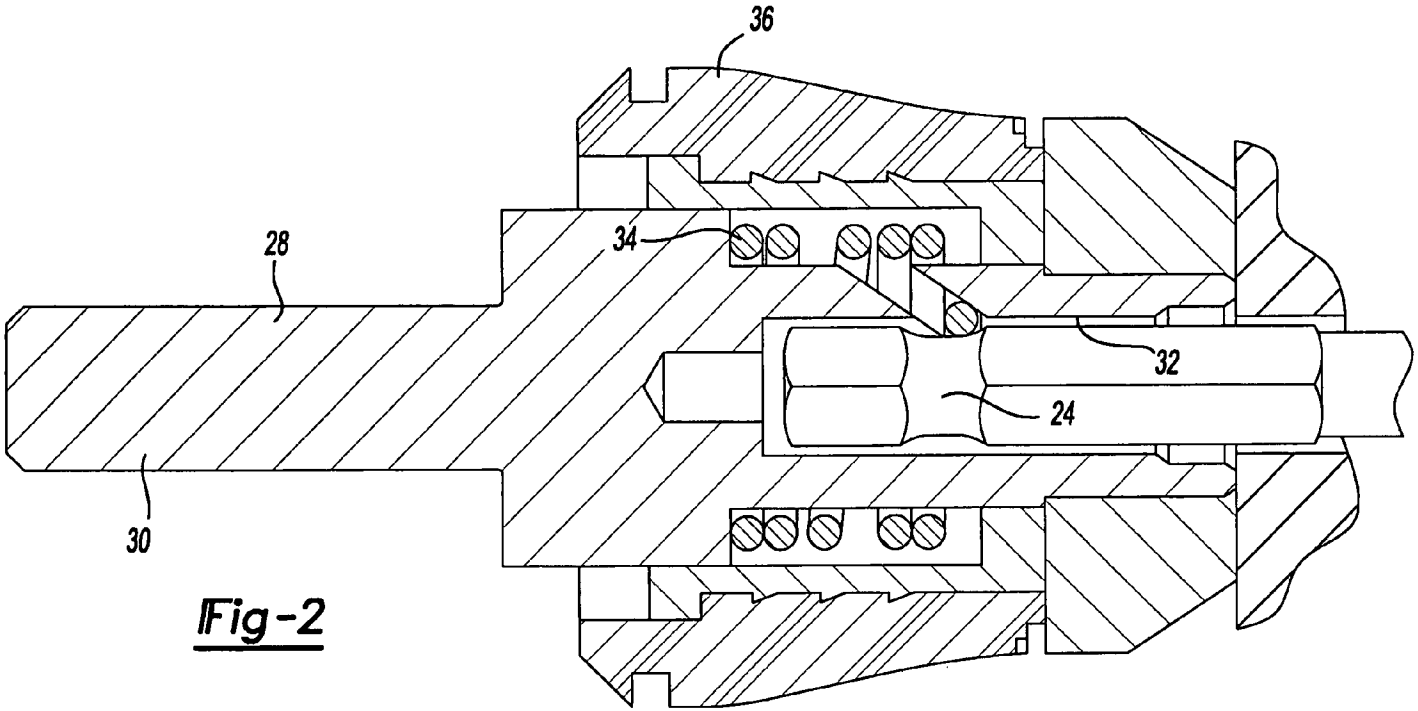
FIG. 2 is a cross-sectional view showing the inner coupling between the rotary tool and the coupler of FIG. 1.
Figure 3:
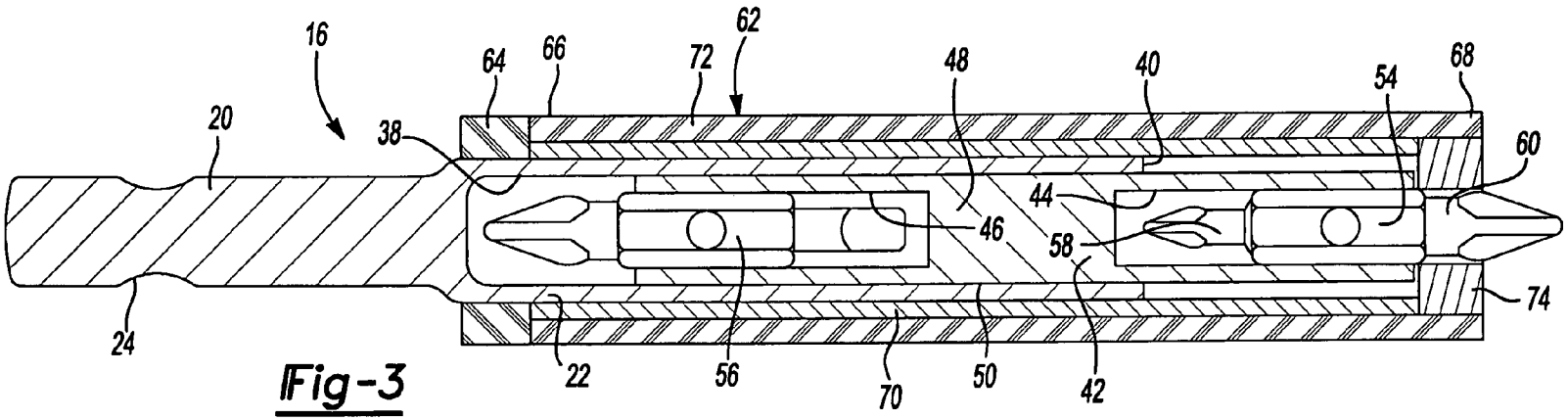
FIG. 3 is a cross-sectional view of the rotary tool of FIG. 1.

As shown in FIGS. 1-3, a rotatable tool 10 is connectable to a power tool 12 or simply a handle (not shown) for rotation about an axis 14. As is described below, the rotatable tool 10 includes a tool holder 16 and a reversible bit assembly 18. The bit assembly 18 is releasably connectable to the tool holder 16, such as by spring biased detent balls, whereby the tool 10 provides six separate drivers for rotating a workpiece. The six drivers may include four bit drivers and two nut drivers. The flexibility of the tool 10 with regard to the number of drivers as well as the tool being configured to allow rotation by a power tool or handle provides advantages not previously provided in the art.

The tool holder 16 includes a shank 20 that is integral with, and that extends rearwardly from, a socket 22. The shank 20 may be hex-shaped and includes a circumferential groove 24. By this construction, the tool holder 16 is connectable to the drill or handle either directly or through a quick release coupler 26. The coupler 26 is generally illustrated in FIG. 2 to include a body 28, having a shaft 30 and an axial opening 32, a detent spring 34, and an actuating sleeve 36. The tool holder shank 20 is disposable in the opening 32 wherein the spring 34 engages the groove 24 to retain the shank 20 within the opening 32 for rotation with the coupler 26. A more detailed description of the coupler 26 is provided in U.S. Pat. No. 6,053,675, assigned to the assignee of the present application, and entitled "Quick-Acting Tool Bit Holder", the disclosure of which is hereby incorporated by reference.

The tool socket 22 includes a bore 38 that extends axially inward from socket end 40 and may also be preferably hex-shaped. The reversible bit assembly 18 includes a sleeve 42 having a pair of axial storage cavities 44 and 46 separated by a web 48. The outer surface 50 of the sleeve 42, each of the cavities 44 and 46, as well as a center section 52 of first and second bit drivers 54 and 56 are each again preferably hex-shaped such that each of the bit drivers 54 and 56 rotate with the sleeve 42 and socket 22. The configuration of a representative tool holder and bit assembly, including the socket, sleeve, and bit drivers, are illustrated and described in greater detail in commonly assigned U.S. Pat. No. 6,354,177, issued Mar. 12, 2002 to Peters and entitled "6 in 1 Rotary Tool," the disclosure of which is hereby incorporated by reference.

Each of the first and second bit drivers 54 and 56 are reversible within their respective cavities 44 and 46 such that either of the bit ends 58 or 60 can extend from sleeve 42. Additionally, the sleeve 42 is reversible within the socket bore 38 such that either the first or second bit drivers 54, 56 operably extend from the socket 22. Accordingly, the tool 10 may be configured such that any of the four bit driver ends operably project from the socket 22. Further, either of the bit drivers 54 and 56 may be removed from the sleeve 42 to expose the hex-shaped cavity 44 or 46 for use as a nut driver. Finally, the tool's sixth driver is provided by removing the reversible bit assembly 18 from the socket bore 38 to expose the hex-shaped bore 38 for use as a second nut driver. It should be noted that bore 38 is larger than cavities 44 and 46, thereby drivably accommodating larger nuts. The bore 38 may be a 5/16 inch hex-opening while the cavities 44, 46 may each be ¼ inch hex-openings.

A rotatable outer sleeve 62 and stop 64 are located on socket 22. Sleeve 62 extends over socket 22, sleeve 42, and bit drivers 54, 56. Sleeve 62 includes first and second ends 66, 68. Sleeve 62 further includes a radially inner portion 70, a radially outer portion 72, and a magnetic ring 74. First end 66 generally abuts stop 64, which is fixed to socket 22. Second end 68 includes magnetic ring 74 disposed therein and generally allows a portion of bit end 60 to pass therethrough for engagement with a fastener (not shown). Sleeve 62 is sized such that the portion of bit end 60 extending past magnetic ring 74 is generally the length required for engagement with a fastener head, thereby allowing the fastener head to seat against magnetic ring 74.

Inner portion 70 may be formed from a metallic material and rotatably engaged with socket 22, which may also be formed from a metallic material. Outer portion 72 extends around inner portion 70 and may be formed from an elastomeric or plastic material. Alternatively, inner and outer portions 70, 72 may be integrally formed from any of the above named materials or any combination thereof. Stop 64 also may be formed from any of the above mentioned materials. Inner portion 70 may have an inner diameter generally equal to the outer diameter of socket 22. Magnetic ring 74 may have an inner diameter generally equal to or slightly larger than the maximum diameter of bit ends, 58, 60. Magnetic ring 74 generally provides for retention of a fastener with bit end 60 through a magnetic attraction therewith before and during use of rotatable tool 10. This allows the user to have a free hand for other uses, such as stabilizing socket 22 while driving a fastener, as discussed below.

As previously noted, sleeve 62 is rotatably engaged with socket 22. This rotatable engagement allows sleeve 62 to remain generally stationary as socket 22 is rotated to drive a fastener. A user may therefore hold sleeve 62 to provide added stability when driving a fastener. Additionally, this allows a user to have sleeve 62 abut a wall or other structure during use of rotatable tool 10 without causing damage that may otherwise result from use of a traditional rotatable tool.

Sleeve 62 is removable from socket 22, allowing access to sleeve 42. This allows for changing of bits 58, 60, or reversal sleeve 42 for access to bit driver 56. This removable feature also allows sleeve 62 to cover a greater portion of bit 58, 60, providing greater retention thereof.

What is claimed is:

1. A rotary tool comprising:

a tool holder including a socket and a shank, the socket having a first end, a second end, and an opening extending rearwardly from said first end toward said second end, said shank being integral with and extending rearwardly from said second end of said socket, said shank having a non-circular cross-section;

a reversible bit having a sleeve, a first reversible bit driver, and a second reversible bit driver, said sleeve including first and second axial end cavities, said first bit driver disposed in said first axial end cavity and coupled to rotate with said sleeve, said second bit driver disposed in said second axial end cavity and coupled to rotate with said sleeve, said first and second axial end cavities being of sufficient axial length to accommodate said first and second reversible bit drivers, and wherein said sleeve is disposed within said socket opening such that said sleeve rotates with said tool holder and one of said first and second bit drivers extends axially out of said socket opening; and a rotatable sleeve disposed over at least a portion of said socket and said bit driver extending axially out of said socket opening, said rotatable sleeve including a magnet in an end proximate said bit driver extending axially out of said socket opening to retain a fastener.

2. The rotary tool of claim 1, wherein said socket defines a hexagonal 5/16-inch nut driver to rotate a workpiece.

3. The rotary tool of claim 1, wherein said first axial end cavity defines a hexagonal ¼-inch nut driver to rotate a workpiece.

4. The rotary tool of claim 1, wherein said second axial end cavity defines a hexagonal ¼-inch nut driver to rotate a workpiece.

5. The rotary tool of claim 1, wherein said bit driver extending axially out of said socket opening includes a bit extending therefrom, said magnet being in the form of a ring and having an inner diameter generally equal to an outer diameter of said bit.

6. The rotary tool of claim 1, wherein said bit driver extending axially out of said socket opening includes a bit extending therefrom, said bit extending through an opening in said rotatable sleeve and at least partially beyond an end of said rotatable sleeve.

7. The rotary tool of claim 6, wherein said bit extends beyond said end of said rotatable sleeve a distance generally equal to an engagement portion of a fastener, thereby allowing a head of the fastener to generally abut said rotatable sleeve.

8. The rotary tool of claim 1, wherein said rotatable sleeve is removably coupled to said socket.

9. A rotary tool comprising:

a tool holder including a shank and a socket, said shank being coupled for rotation with said socket and adapted to be coupled to a power driven rotary drive, said socket defining a first nut driver for rotating a workpiece;

a reversible bit including a sleeve disposed in an opening in said socket and defining first and second end cavities, a first bit driver having a first bit end and a second bit end, and a second bit driver having a first bit end and a second bit end, said first bit driver being selectively disposable within said first end cavity for rotation with said sleeve in a first position where said first bit end extends from said sleeve and second position where said second bit end extends from said sleeve, said second bit driver being selectively disposable within said second end cavity for rotation with said sleeve in a first position where said first bit end of said second bit driver extends from said sleeve and a second position where said second bit end of said second bit driver extends from said sleeve, said first bit driver being removable from said first end cavity wherein said first end cavity defines a second nut driver for rotating a workpiece, said first end cavity being smaller than said socket; and a rotatable sleeve disposed over at least a portion of said socket and said bit driver extending axially out of said socket opening, said rotatable sleeve including a magnet in an end proximate said bit driver extending axially out of said socket opening to retain a fastener.

10. The rotary tool of claim 9, wherein said socket and shank are of one-piece construction.

11. The rotary tool of claim 9, wherein said bit driver extending axially out of said socket opening includes a bit extending therefrom, said magnet being in the form of a ring and having an inner diameter generally equal to an outer diameter of said bit.

12. The rotary tool of claim 9, wherein said bit driver extending axially out of said socket opening includes a bit extending therefrom, said bit extending through an opening in said rotatable sleeve and at least partially beyond an end of said rotatable sleeve.

13. The rotary tool of claim 12, wherein said bit extends beyond said end of said rotatable sleeve a distance generally equal to an engagement portion of a fastener, thereby allowing a head of the fastener to generally abut said rotatable sleeve.

14. A tool assembly comprising:

a quick release coupler having a shank, a body, and a detent assembly, said shank adapted to be coupled to a handle or a power tool, said body defining a passage;

a tool holder having a shank and a socket, said shank being disposable in said passage and engaged by said detent assembly whereby said tool holder is coupled for rotation with said coupler;

a reversible bit having a sleeve disposed in an opening in said socket, a first bit driver, and a second bit driver, said sleeve including first and second axial end cavities, said first bit driver disposed in said first axial end cavity and coupled to rotate with said sleeve, said second bit driver disposed in said second axial end cavity and coupled to rotate with said sleeve, and wherein said sleeve is disposed within said socket opening such that said sleeve rotates with said tool holder and one of said first and second bit drivers extends axially out of said opening; and a rotatable sleeve rotatably disposed over at least a portion of said socket and said bit driver extending axially out of said socket opening, said rotatable sleeve including a magnet in an end proximate said bit driver extending axially out of said socket opening to retain a fastener.

15. The rotary tool of claim 14, wherein said bit driver extending axially out of said socket opening includes a bit extending therefrom, said magnet being in the form of a ring and having an inner diameter generally equal to an outer diameter of said bit.

16. The rotary tool of claim 14, wherein said bit driver extending axially out of said socket opening includes a bit extending therefrom, said bit extending through an opening in said rotatable sleeve and at least partially beyond an end of said rotatable sleeve.

17. The rotary tool of claim 16, wherein said bit extends beyond said end of said rotatable sleeve a distance generally equal to an engagement portion of a fastener, thereby allowing a head of the fastener to generally abut said rotatable sleeve.

* * * * *